US005551607A

United States Patent [19]

DeJonge, Sr. et al.

[11] Patent Number: 5,551,607

[45] Date of Patent: Sep. 3, 1996

[54] DISPENSING CAP WITH LEVERAGED PIVOT TRIGGER

[75] Inventors: Stuart DeJonge, Sr., Easton, Pa.; John E. Harrold, Borough of Bloomsbury, N.J.

[73] Assignee: Primary Delivery Systems, Inc., Easton, Pa.

[21] Appl. No.: 511,758

[22] Filed: Aug. 7, 1995

[51] Int. Cl.[6] ..... B67D 3/00

[52] U.S. Cl. ..... 222/505; 222/546; 222/556

[58] Field of Search ..... 222/505, 498, 222/546, 556, 153.14

[56] References Cited

U.S. PATENT DOCUMENTS

| | | | |
|---|---|---|---|
| 3,874,568 | 4/1975 | LaVange et al. | 222/556 X |
| 3,881,643 | 5/1975 | LaVange | 222/505 |
| 4,632,266 | 12/1986 | Osswald . | |
| 4,962,869 | 10/1990 | Gross et al. . | |
| 4,993,606 | 2/1991 | Bolen, Jr. et al. . | |
| 5,236,107 | 8/1993 | Spaanstra, Sr. . | |
| 5,251,793 | 10/1993 | Bolen, Jr. et al. . | |

*Primary Examiner*—Gregory L. Huson
*Attorney, Agent, or Firm*—Kenneth P. Glynn

[57] ABSTRACT

The present invention is a container dispensing cap closure, which includes a container, a circular base and a pivot cap. The container has a neck, an open top and external threading for affixing a circular base thereto. The circular base has a circular inside wall with internal threading for attachment to the neck of the container. The circular base has an inwardly flexible leveraged sidewall trigger with a catch thereon which, when flexed inwardly, engages and pivots a pivot cap upwardly into an open position. The circular base has an upwardly extending guide-wall that regulates the pivotal rotation of the pivot cap, and an opening from which contents may be dispensed. The pivot cap is attached to the circular base by a clasp-element which is attached to two raised sidewall tracts located on the top of the circular base. The raised sidewall tracts comprise impressions which interact with snap-in-bead protrusions located on the clasp-element, thus allowing the pivot cap to pivot thereabout. The snap-in-bead protrusions and impressions are in frictional contact thus stabilizing the pivotal rotation of the pivot cap. The pivot cap also has a flat top and a lip which extends downwardly about the perimeter of the pivot cap. When the pivot cap is in a closed position the lip rests upon the top of the circular base. The pivot cap has a plug which, when the pivot cap is in a closed position, seals the opening on the circular base.

34 Claims, 4 Drawing Sheets

DISPENSING CAP WITH LEVERAGED PIVOT TRIGGER

BACKGROUND OF THE INVENTION

1. Field of the Invention

The present invention relates to pivotal dispensing caps, and more particularly to dispensing caps with an inwardly flexible, leveraged pivot trigger means and a pivotal pivot cap.

2. Information Disclosure Statement

Pivotal dispensing caps are well known and have been utilized to dispense products such as shampoos, liquid soaps, lotions, gels, powders and the like for some time. The objective of such dispensing devices is to provide the consumer with a practical and appealing means for dispensing such products, while at the same time providing a preferable means for repeated opening and resealing of the dispensing devices without the inconvenience of complete cap removal. The following patents represent different variations on pivotal dispensing devices which exemplify the art:

U.S. Pat. No. 4,632,266 to Otto Osswald describes a cylindrical closed ended molded plastic cap which includes a planar molded plastic tab, pivotally mountable within a tab recess. The pivotal tab is pivotal between an open and closed position and includes tines which cooperate with grooves on the tab recess which combine to resist separation of the tab from the tab recess.

U.S. Pat. No. 4,962,869 to Richard A. Gross and Bruce M. Mueller sets forth a toggle-acting closure with a permanently deformable resistance post which interferes with the pivoting of the actuator until a substantial force is applied to the actuator. The actuator has a closed non-dispensing position and an open dispensing position. The actuator, when in the non-dispensing position, is pivotally received in a recess located in the closure and when toggled is pivoted to the dispensing position.

U.S. Pat. No. 4,993,606 to Robert J. Bolen, Jr. and Thomas R. Bolen describes a two piece dispensing closure which has an internally threaded base with a dispensing orifice located in the front section and an elevated rear land which has a pivot recess adapted to receive a separate lid that rotates at least 90° from open to closed positions. The front section of the lid is circular and has a pivot post located at its rear. When the lid is closed the upper surfaces of the lid and the base are co-planar.

U.S. Pat. No. 5,236,107 to Lambert Spaanstra, Sr. describes a dispensing cap mechanism comprising a closure button which is pivotally mounted in an upper portion of a tubular cap body. The closure button and cap body have communicating discharge passages, and the closure button has an orifice located at the end of its discharge passage. The upper end of the discharge passage extends upward from an opening in a transverse wall to a point just below the plane of the top rim of the cap body. The bottom end of the cap body has an internal thread in the lower body skirt portion to enable the cap body to be screwed onto the threaded neck of a container.

U.S. Pat. No. 5,251,793 to Robert J. Bolen, Jr. and Thomas R. Bolen describes a two piece dispensing closure which has an internally threaded base with a dispensing orifice located in the front section and an elevated rear land which has a pivot recess adapted to receive a separate lid that rotates at least 90° from open to closed positions. The front section of the lid is circular and has a pivot post located at its rear. When the lid is closed the upper surfaces of the lid and the base are co-planar and the closure maintains the appearance of a conventional screw cap.

Notwithstanding the significant prior art in this field, it is believed that the present invention, which utilizes an inwardly flexible sidewall trigger means that acts as a lever for a pivotal pivot cap, as described herein, is neither taught nor rendered obvious.

SUMMARY OF THE INVENTION

The present invention is a container dispensing cap closure, which includes a container, a circular base and a pivot cap. The container has a neck, an open top and has means thereon, such as external threading, for affixing a circular base thereto. The circular base has a circular inside wall with means thereon, such as internal threading, for attachment to the neck of the container. The circular base also has an inwardly flexible leveraged sidewall trigger means with a catch thereon which, when flexed inwardly, engages and pivots a pivot cap upwardly into an open position. The circular base also has an upwardly extending guide-wall that regulates the pivotal rotation of the pivot cap, and an opening from which contents may be dispensed. In preferred embodiments, the pivot cap is attached to the circular base by a clasp-element which is attached to two raised sidewall tracts extending upwardly from the top of the circular base. The raised sidewall tracts comprise impressions which interact with snap-in bead protrusions located on the clasp-element, thus allowing the pivot cap to rotate (pivot) thereabout. In more preferred embodiments, the snap-in-bead protrusions and impressions are in frictional contact thus stabilizing the pivotal rotation of the pivot cap. In preferred embodiments, the pivot cap also has a flat top and a lip which extends downwardly about the perimeter of the pivot cap. When the pivot cap is in a closed position the lip rests upon the top of the circular base. The pivot cap also has a plug which, when the pivot cap is in a closed position, seals the opening on the circular base.

BRIEF DESCRIPTION OF THE DRAWINGS

The present invention will be more fully understood when the specification herein is taken in conjunction with the drawings appended hereto, wherein.

DETAILED DESCRIPTION OF THE INVENTION

The present invention is a container dispensing cap closure. It includes a container with a neck, a circular base and a pivot cap. The container may be made of molded plastic, glass, or any other acceptable commercial stock. The neck of the container has means thereon, such as external threading, adapted to affix the circular base thereto. Other means, such as crimping, heat sealing force fitting or any other known attachment means may also be employed.

The container dispensing cap closure comprises a circular base and a pivot cap. In preferred embodiments the pivot cap is attached to the circular base by a clasp-element which is affixed to two elevated sidewall tracts extending upwardly from an inwardly biased sidewall portion of the circular base. The pivot cap pivots between an open and closed position and has a plug which seals an opening located on the top of the circular base when the pivot cap is in a closed position. An inwardly flexible sidewall trigger means, extending upwardly from the circular base, engages the pivot cap and pivots the pivot cap into an open position. In order to open the cap, a user presses the flexible sidewall trigger inwardly, causing the pivot cap to pivot into an open position. Once contents have been dispensed, the user manually closes the pivot cap, thereby sealing the closure. Thus, the sidewall trigger is user friendly due to the relative ease of inward flexion.

Figure 1:
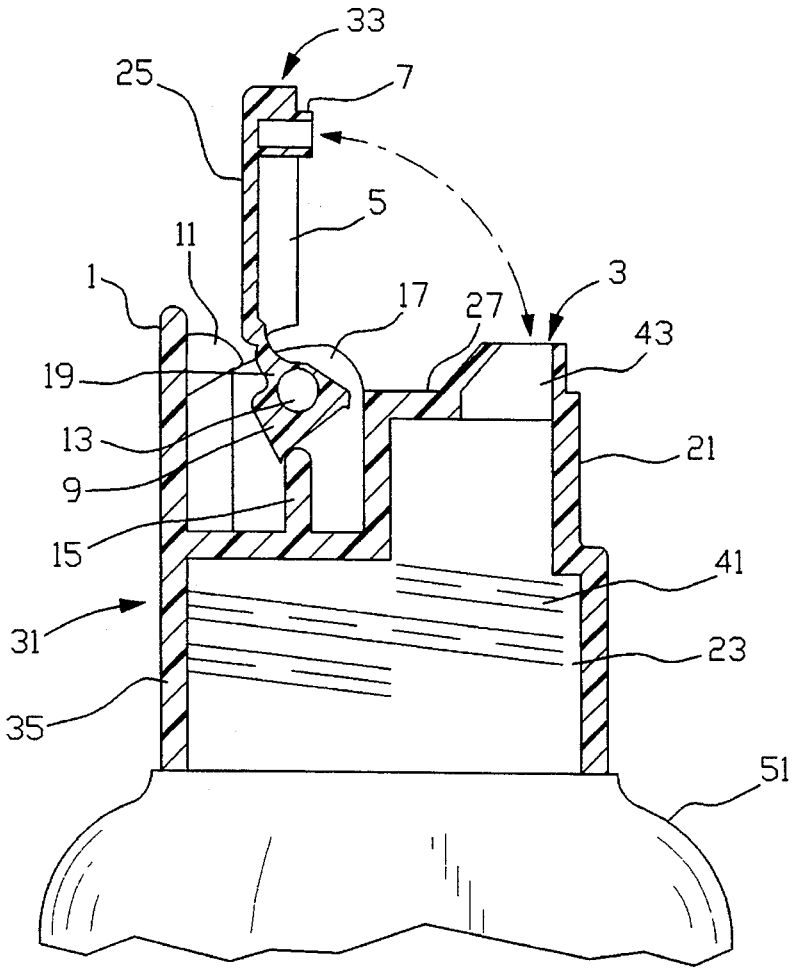
FIG. 1 shows a partially cut partial side view of a pivot cap and circular base of a present invention container dispensing cap closure.

FIG. 1 shows a partially cut partial side view of a preferred embodiment of a present invention dispensing cap closure with pivot cap 33 in an open position. Here, circular base 35 has circular inside wall 23 which has threading 41 thereon for affixing circular base 35 to the neck of the container 51. Opening 3 is shown in its cut side view comprising raised rim 43, extending upwardly from flat horizontal top portion 27. Alternatively, opening 3 could be level with horizontal top portion 27, as discussed in more detail with respect to FIG. 7 below. Pivot cap 33 is shown in its cut side view and has flat top 25, plug 7 and lip 5, which extends downwardly about the perimeter of pivot cap 33.

Figure 2:
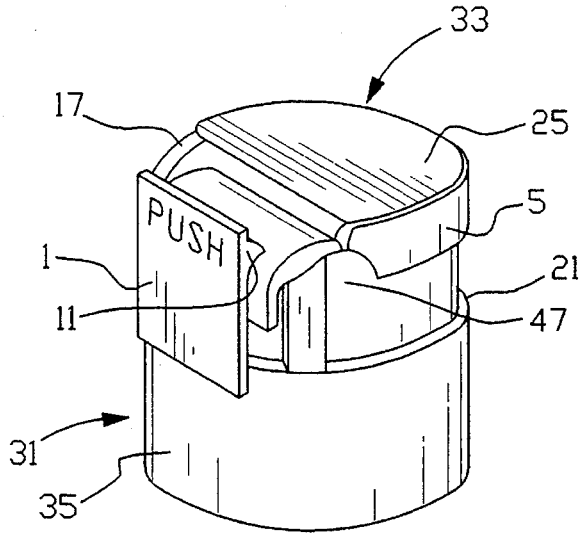
FIG. 2 shows an external side view of a present invention container dispensing cap closure.

FIG. 2 shows an external side view of a preferred embodiment of a present invention container dispensing cap closure with pivot cap 33 in a closed position. Identical parts are identically numbered.

Referring to FIGS. 1 and 2 pivot cap 33 is attached to circular base 35 by clasp-element 9 which is affixed to raised sidewall tracts 17 and 47. In preferred embodiments there is at least one clasp-element, however, two clasp-elements may be employed, i.e. two clasp-elements engage the outside of two inwardly biased raised sidewall tracts on opposite sides. In this case, clasp-element 9 has two snap-in-bead protrusions 13 on either side which "snap" into and engage impressions 19, which are located on the inner side of raised sidewall tracts 17 and 47. Each snap-in-bead protrusion is of adequate geometry to flexibly snap into the impression and to frictionally engage the impression once inside, thus stabilizing the movement of pivot cap 33. Alternatively, raised sidewall tracts 17 and 47 could comprise snap-in-bead protrusions and clasp-element 9 could comprise impressions. In other words, it is not critical as to whether the clasp-element or the raised tracts have the impression or the snap-in-bead. In addition, one snap-in-bead and impression could be employed as opposed to two, i.e. one snap-in-bead located on one side of a clasp-element and one impression located on the inner side of one sidewall tract. In another alternative embodiment there may also be a raised elongated horizontal tract which extends horizontally from one side of the circular base to the other. In such an instance, the clasp-element may either engage the elongated region on the outer sides, or in a cavity located within the raised tract. As another alternative, the raised sidewall tracts could comprise a horizontal cylindrical shaft, as discussed in more detail with respect to FIG. 7 below.

Referring still to FIGS. 1 and 2, pivot cap 33 is pivotal between an open and closed position. When pivot cap 33 is in a closed position, plug 7 seals opening 3 and lip 5 rests upon the outer edge of horizontal top portion 27 of circular base 35. Alternatively, pivot cap 33 could rest within a recessed portion of circular base 35, as discussed in more detail with respect to FIG. 4 below. Pivot cap 33 pivotally rotates when engaged by inwardly flexible sidewall trigger 1 of circular base 35. Sidewall trigger 1 comprises catch 11 which, when sidewall trigger 1 is flexed inwardly, engages a portion of clasp-element 9 and then pivots pivot cap 33 into an open position. In preferred embodiments, once a user has pivoted pivot cap 33 into an open position, pivot cap 33 will remain in an open position until the user manually moves pivot cap 33 into a closed position. Thus, in such an embodiment, protrusions and impressions are in adequate frictional contact such that a user may apply inward pressure to sidewall trigger 1 and pivot cap 33 will then pivot into an open position and will remain open until the user manually moves pivot cap 33 into a closed position. Circular base 35 also has guide-wall 15, which regulates the pivotal rotation of pivot cap 33. Thus, in preferred embodiments, a portion of clasp-element 9 encounters guide-wall 15 at a finite open position after pivot cap 33 has been pivoted open, i.e. pivot cap 33 pivots 90°, and then is halted by guide-wall 15. Alternatively, pivot cap 33 could pivot 10°, as discussed with respect to FIGS. 5 and 6 below.

Figure 3:
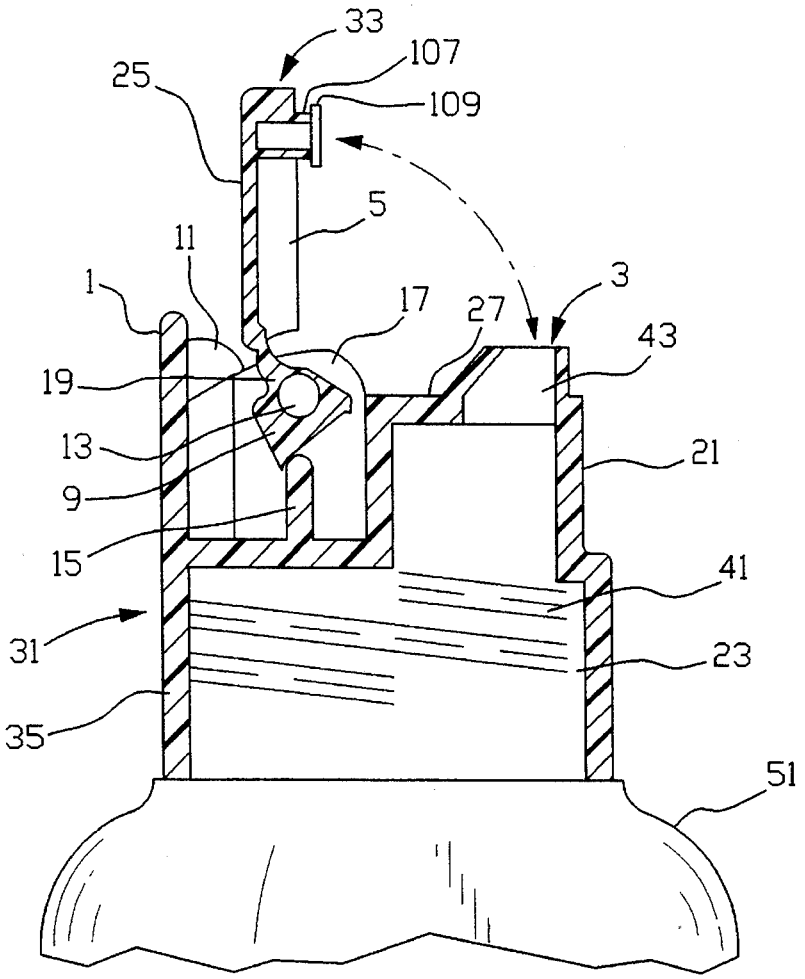
FIG. 3 shows a partially cut partial side view of an alternative embodiment of a present invention container dispensing cap closure.

FIG. 3 shows a partially cut partial side view of an alternative embodiment of a present container dispensing cap closure. Identical parts are identically numbered. Here, plug 107 has annular protrusion 109. When pivot cap 33 is in a closed position, protrusion 109 rests directly below the bottom surface of opening 3, securing pivot cap 33 in place. Thus, when a user moves pivot cap 33 into a closed position, protrusion 109 flexes inwardly and plug 107 moves through opening 3 and then "snaps" into position, sealing opening 3 and securing pivot cap 33 in a closed position. When the user applies inward pressure to sidewall trigger 1, protrusion 109 flexes inwardly as pivot cap 33 rotates upward, allowing plug 107 to move through opening 3 with limited friction.

Figure 4:
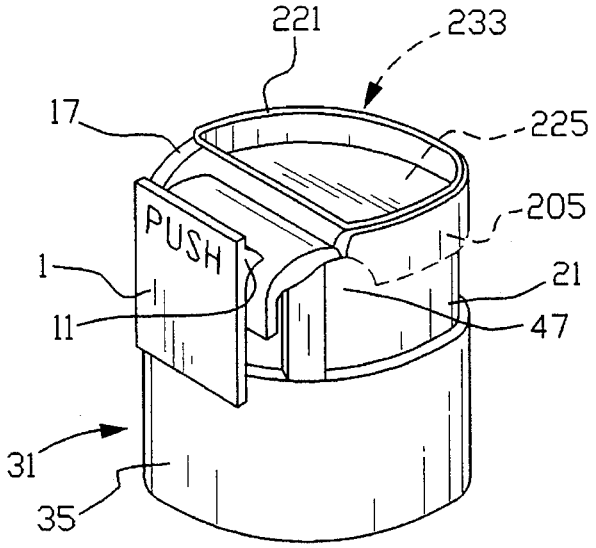
FIG. 4 shows an external side view of an alternative embodiment of a present invention container dispensing cap closure.

FIG. 4 shows an external side view of an alternative embodiment of a present invention container dispensing cap closure. Identical parts are identically numbered. Here pivot cap 233 has flat top 225 and downwardly extending lip 205. When pivot cap 233 is in a closed position, top 225 is level with the top edge of upwardly extending skirt 221 of circular base 35. Thus, pivot cap 233 is of adequate geometric dimension to fit into a recessed area located inside skirt 221 of circular base 35 when pivot cap 233 is in a closed position. In another alternative embodiment, for example, the lip of the pivot cap may be biased inwardly and an outer ledge portion of the of the pivot cap may then rest upon the top edge of the skirt when the pivot cap is in a closed position. In other words, it is not critical that the top of the pivot cap be level with the top edge of the skirt in such an alternative embodiment.

Figure 5:
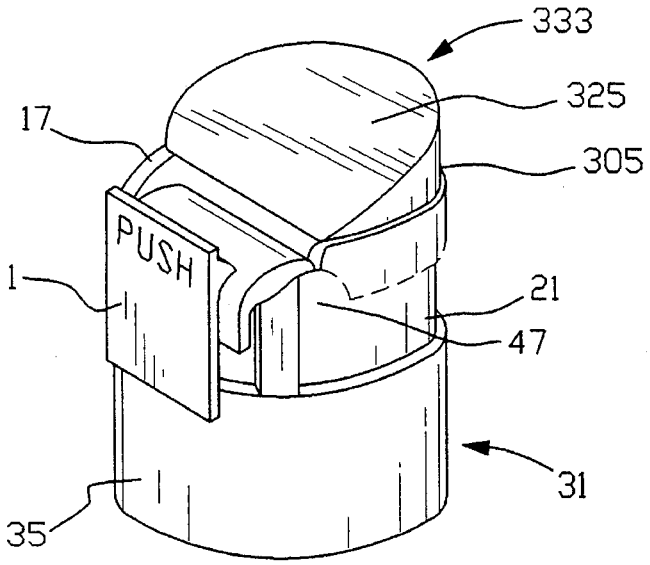
FIGS. 5 and 6 show external side and front views, respectively, of an alternative embodiment of a present invention container dispensing cap closure; and, FIG. 7 shows a partially cut partial side view of an alternative embodiment of a present invention container dispensing cap closure.
Figure 6:
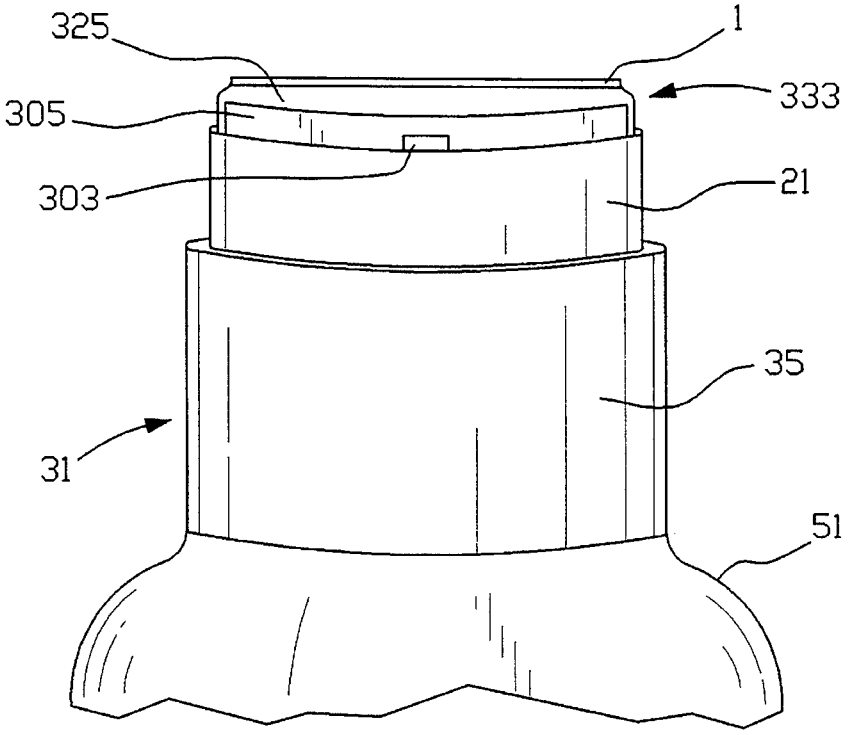

FIGS. 5 and 6 show external side and front views, respectively, of an alternative embodiment of a present invention container dispensing cap closure. Identical parts are identically numbered. Pivot cap 333 has top 325, lip 305 and opening 303. Here, for example, pivot cap 333 pivots 10°, to an open position, however, any other finite degree of rotation may be employed. Thus, referring to FIGS. 1, 5 and 6, the pivotal rotation of the pivot cap is regulated by a guide-wall, which ensures a finite open position. Referring to FIGS. 5 and 6, cut out 303 may be located in lip 305 and circular base 35 may comprise a completely open top opening, however, it is not necessary that the opening be structured in such a manner, i.e. a pivotal rotation of 40° would still permit the opening to remain functional from a position on the top portion of circular base 35 as described with reference to FIG. 1 above.

Figure 7:
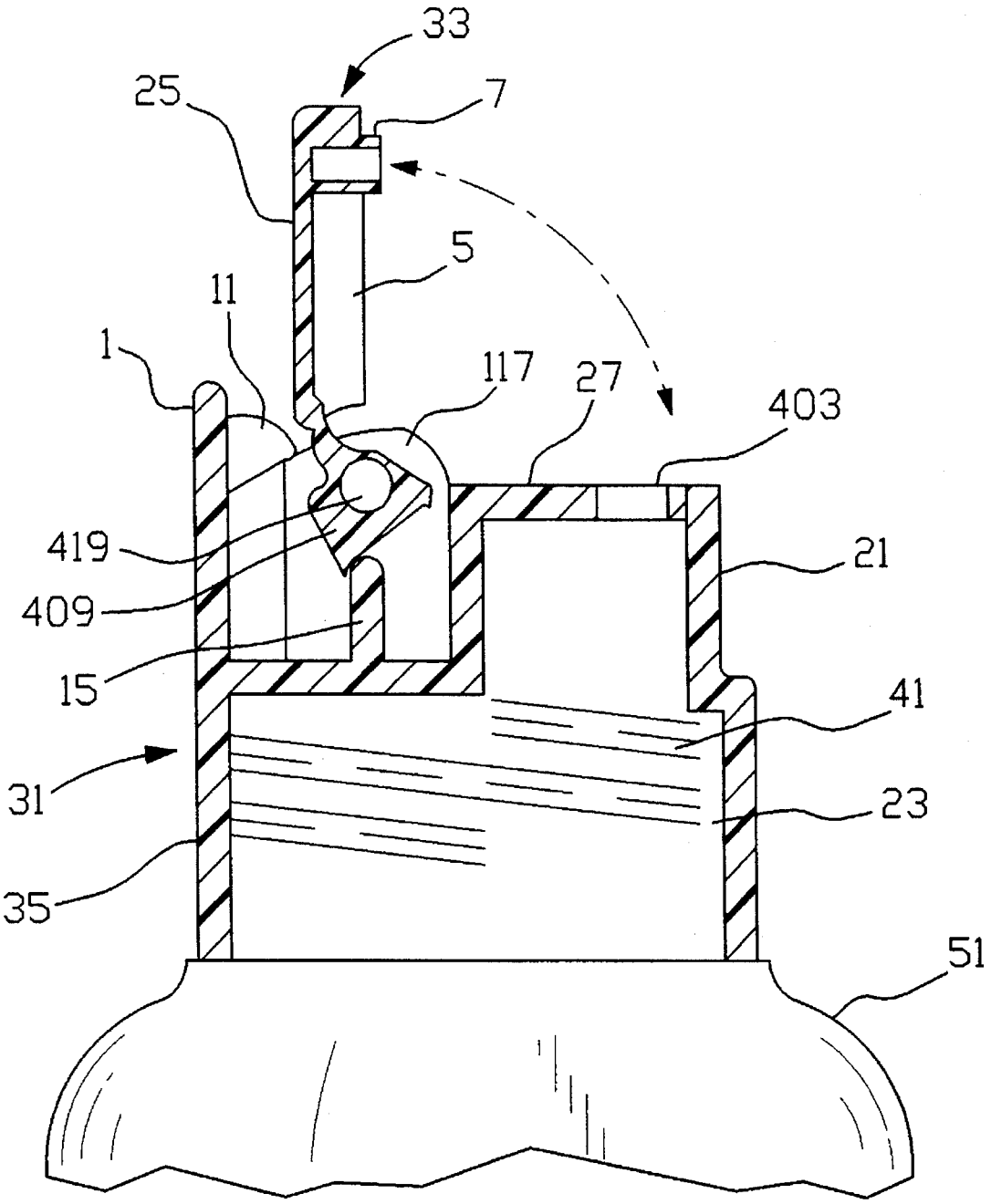

FIG. 7 shows a partially cut partial side view of an alternative embodiment of a present invention dispensing cap closure. Identical parts are identically numbered. Raised tract 417 comprises a horizontal cylindrical shaft 419, shown in its cut side view, which extends from one raised sidewall tract to the other. Pivot cap 33 is fastened to shaft 419 by clasp-element 409, which comprises a flexible shaft-fastening means. Thus, clasp-element 409 is of adequate geometric dimension and flexibility to flex outwardly and "clip" onto shaft 419 and pivot thereabout. In such an embodiment, clasp-element 409 also has adequate geometric dimension to frictionally engage shaft 419 once attached thereto, further stabilizing the movement of pivot cap 33. Here, opening 403 is shown in its cut side view and is a level cut-out located within horizontal top portion 27 of circular base 35.

Obviously, numerous modifications and variations of the present invention are possible in light of the above teachings. It is therefore understood that within the scope of the appended claims, the invention may be practiced otherwise than as specifically described herein.

What is claimed is:

1. A container and dispensing cap closure mechanism therefore, which comprises:

(a) a container having a neck, an open top and means thereon, adapted to receive and affix a circular base thereto;

(b) a circular base having a circular inside wall with means thereon for attachment to said container, said circular base also having an opening, a flat horizontal top surface portion, a portion for affixing a pivot cap thereto, means adapted to regulate the pivotal rotation of a pivot cap, and also having an inwardly flexible leveraged sidewall trigger means with a catch thereon adapted to engage and pivot a pivot cap; and, (c) a pivot cap having means to attach to and pivotally engage a portion of said circular base, said pivot cap also having a plug thereon.

2. The device of claim 1 wherein said circular inside wall of said circular base has attachment means whereby said circular base may be rotatably affixed to said neck of said container.

3. The device of claim 2 wherein said attachment means is internal threading.

4. The device of claim 1 wherein said circular base comprises an inwardly biased sidewall portion.

5. The device of claim 1 wherein said opening of said circular base comprises a raised rim and an orifice.

6. The device of claim 1 wherein said opening of said circular base comprises an orifice that is level with said horizontal surface portion of said circular base.

7. The device of claim 1 wherein said opening of said circular base comprises an open top adapted to function with a cut out on said pivot cap.

8. The device of claim 1 wherein said circular base comprises a raised tract portion with means thereon adapted to attach and pivotally affix said pivot cap thereto.

9. The device of claim 8 wherein said raised track comprises two upwardly extending sidewall portions.

10. The device of claim 9 wherein said raised sidewall portions comprise at least one impression adapted to receive at least one snap-in-bead protrusion.

11. The device of claim 9 wherein said raised sidewall portions comprise at least one snap-in-bead protrusion of adequate geometry to frictionally engage an impression.

12. The device of claim 8 wherein said raised tract comprises a raised elongated region extending horizontally across said circular base.

13. The device of claim 12 wherein said raised elongated region comprises at least one impression adapted to receive at least one snap-in-bead protrusion.

14. The device of claim 12 wherein said raised elongated region comprises at least one snap-in-bead protrusion of adequate geometry to frictionally engage an impression.

15. The device of claim 12 wherein said raised elongated region has a cavity therein adapted to receive and affix a clasp element thereto.

16. The device of claim 15 wherein said cavity comprises at least one impression adapted to receive at least one snap-in-bead protrusion.

17. The device of claim 15 wherein said cavity comprises at least one snap-in-bead protrusion of adequate geometry to frictionally engage an impression.

18. The device of claim 9 wherein said raised sidewall portions comprise a horizontal cylindrical shaft.

19. The device of claim 1 wherein said circular base comprises an upwardly extending guide-wall adapted to regulate the pivotal rotation of said pivot cap.

20. The device of claim 1 wherein said circular base comprises a recessed area and upwardly extending skirt adapted to receive said pivot cap therein.

21. The device of claim 1 wherein said pivot cap comprises a flat top and a downwardly extending lip about its perimeter.

22. The device of claim 21 wherein said lip comprises a cut-out opening thereon.

23. The device of claim 1 wherein said pivot cap is of adequate dimension to fit inside a recessed area of said circular base.

24. The device of claim 1 wherein said pivot cap comprises a clasp-element adapted to affix said pivot cap to said circular base.

25. The device of claim 24 wherein said clasp-element is adapted to engage said catch of said inwardly flexible leverage side-wall trigger means.

26. The device of claim 24 wherein said clasp-element is adapted to encounter said circular inside wall of said circular base at a finite open position.

27. The device of claim 24 wherein said clasp-element is adapted to attach said pivot cap to said raised tract of a circular base.

28. The device of claim 27 wherein said clasp-element comprises at least one impression adapted to receive at least one snap-in-bead protrusion.

29. The device of claim 27 wherein said clasp-element comprises at least one outwardly extending snap-in-bead protrusion of adequate geometry to frictionally engage an impression.

30. The device of claim 27 wherein said clasp element is adapted to fit into a cavity within said raised tract.

31. The device of claim 30 wherein said clasp-element comprises at least one impression adapted to receive at least one snap-in-bead protrusion.

32. The device of claim 30 wherein said clasp-element comprises at least one outwardly extending snap-in-bead protrusion of adequate geometry to frictionally engage an impression.

33. The device of claim 24 wherein said clasp-element is adapted to flexibly snap onto, rotate about and frictionally engage a horizontal cylindrical shaft.

34. The device of claim 1 wherein said plug has an annular protrusion thereon, wherein said protrusion is inwardly flexible to frictionally pass through said opening of said circular base and to secure said pivot cap in a closed position.

* * * * *